US005544921A

United States Patent [19]

Cynan et al.

[11] Patent Number: 5,544,921

[45] Date of Patent: Aug. 13, 1996

[54] PACKAGE VERIFICATION METHOD

[75] Inventors: T. F. Cynan, Grand Island; Dennis C. Pollutro, Cherry Creek, both of N.Y.

[73] Assignee: Moore Business Forms, Inc., Grand Island, N.Y.

[21] Appl. No.: 45,200

[22] Filed: Apr. 13, 1993

[51] Int. Cl.[6] ..... B42D 15/08

[52] U.S. Cl. ..... 283/70; 235/375

[58] Field of Search ..... 283/67, 70, 82, 283/106, 901; 235/375, 379, 380, 381, 493, 494; 364/406, 408; 53/284.3; 270/20.1

[56] References Cited

U.S. PATENT DOCUMENTS

| | | | |
|---|---|---|---|
| 3,509,535 | 4/1970 | Berube | 340/149 |
| 4,034,210 | 7/1977 | Hill et al. . | |
| 4,194,685 | 3/1980 | Hill et al. | 235/375 |
| 4,218,612 | 8/1980 | Krehl et al. | 235/449 |
| 4,518,919 | 5/1985 | Ishida | 324/228 |
| 4,734,643 | 3/1988 | Bubenik et al. | 324/232 |
| 4,900,904 | 2/1990 | Wright et al. | 235/380 X |
| 5,028,040 | 7/1991 | Kalisiak | 270/52 |
| 5,033,725 | 7/1991 | Duursen | 270/52 |
| 5,237,156 | 8/1993 | Konishi et al. | 235/375 |

OTHER PUBLICATIONS

Thomas Register Catalog file for Vikron, Inc., Read–After–Write Digital Magnetic Heads, pp. 12389–12396, 1983.

*Primary Examiner*—Peter Vo

*Attorney, Agent, or Firm*—Nixon & Vanderhye

[57] ABSTRACT

It is possible to determine whether the correct business form parts have been properly provided in an outgoing package (e.g., mailing envelope) containing a plurality of parts, utilizing a magnetic detector capable of detecting magnetic toner within the package. Dense patterns of magnetic toner are imaged on portions of each of the business form parts, located at different positions on different parts. Then the parts are formed into a package (as by folding about fold lines into a self-contained mailer, or inserting into a mailing envelope), and the package is moved with respect to a magnetic detector. The magnetic detector senses the dense magnetic toner patterns within the package to determine whether all the correct parts are properly in the package by determining whether all business form parts in the package have the detectable magnetic toner indicia patterns on the predetermined portions. The dense patterns of magnetic toner are preferably in the form of solid toner rectangles disposed in a straight line configuration, and the package is moved in a straight line with respect to the detector. A multi-part business form is also provided, having dense patterns of magnetic toner and less dense alphanumeric indicia on the plural plies of the business form, which may be a self-contained mailer or parts inserted into a mailing envelope.

20 Claims, 2 Drawing Sheets

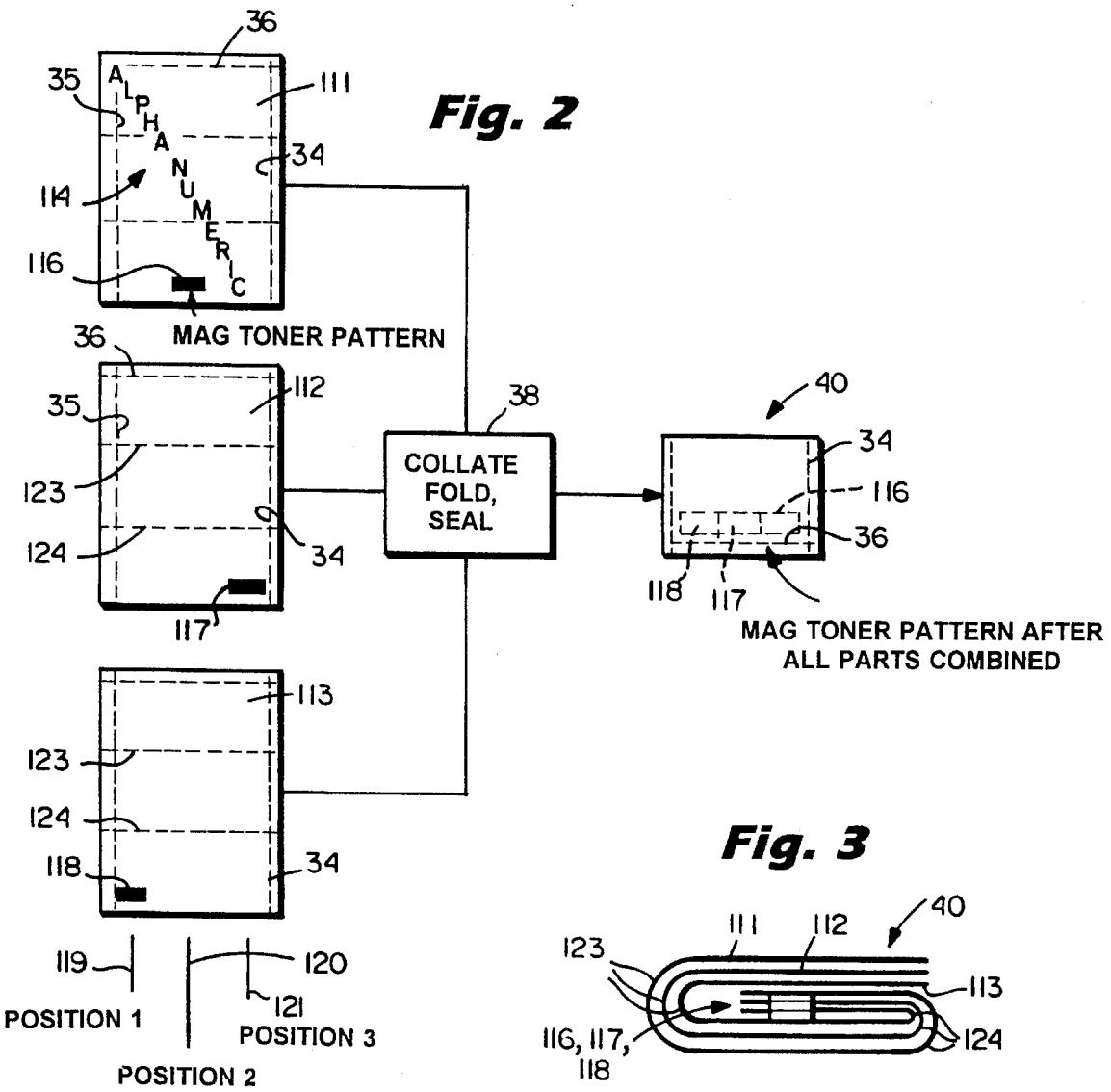
Fig. 2
Fig. 3
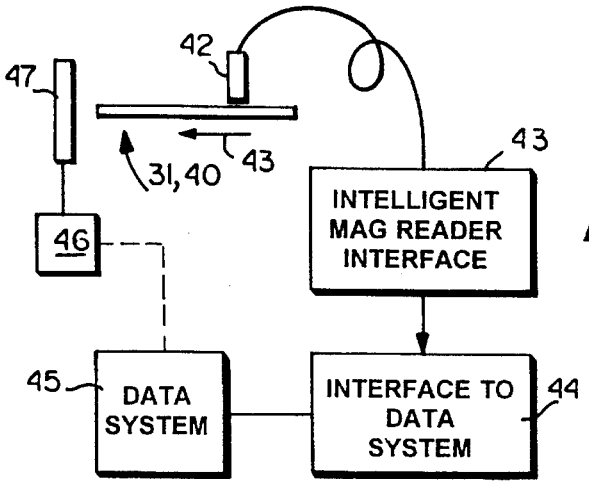
Fig. 4

PACKAGE VERIFICATION METHOD

BACKGROUND AND SUMMARY OF THE INVENTION

There are a number of situations during the construction of documents to be mailed where variably imaged parts or selectable inserts are gathered together to form a self-contained mailer, or to be inserted into an envelope or like package. Once-the parts/inserts have been gathered and formed into a self-contained mailer or inserted into an envelope, it is difficult to know whether the correct inserts or parts are provided in the final product, which is "sealed". If the correct parts are not provided, of course, it can be futile to send out the business form since the recipient will not have proper information, a reply envelope, coupons, or other information or elements designed to be transmitted to the recipient.

Some systems attempt to solve this problem by using detectors to sense and match the individual parts/inserts prior to construction of the package to be mailed. However, this typically requires multiple detectors and/or can have an adverse affect on the speed of forming the final mailable packages, both of which are obviously undesirable, and mistakes can still occur.

According to the present invention, a multi-part business form is provided which can easily be acted upon to determine whether or not all of the desired parts thereof are properly provided in the mailable package, and a method is provided for determining whether the correct business form parts have been provided in an outgoing package containing a plurality of parts. According to the present invention it is possible to form the mailable packages in an entirely standard manner, without any adverse affect on the speed of construction, or without requiring additional steps during construction.

According to one aspect of the present invention a method of determining whether the correct business form parts have been provided in an outgoing package containing a plurality of parts is provided, the method utilizing a magnetic detector capable of detecting magnetic toner within the package. The method comprises the following steps: (a) Imaging predetermined detectable indicia with magnetic toner on predetermined portions of each of the business form parts, the indicia located at a different position on different parts. Then (b) forming the business form parts into a package so that the detectable magnetic toner indicia is covered by at least one sheet of material. Then (c) moving the magnetic detector and package with respect to each other so that the magnetic detector is positioned to sense the detectable magnetic toner indicia within the package. And then (d) sensing the detectable magnetic toner indicia within the package to determine whether all the correct parts are properly in the package by determining whether all business form parts within the package have the predetermined magnetic toner detectable indicia on the predetermined portions thereof. Step (a) is practiced during normal printing of the business form parts, e.g., with a Midax printer, which normally prints with magnetics toner, the printer imaging alphanumeric indicia on the parts at the same time as the detectable indicia are imaged. The detectable indicia is typically in the form of rectangles or like patterns of dense magnetic toner, while the alphanumeric indicia being imaged on other portions of the business form at the same time is in much less dense form.

The method according to the invention also comprises the further step, in response to step (d), of rejecting a package if it is determined that the package does not have the predetermined magnetic toner detectable indicia on the predetermined portions thereof, i.e., if less than the correct parts are in the package. Preferably step (a) is practiced to image the dense detectable indicia so that the indicia is disposed in a substantially straight line, and step (c) is preferably practiced by moving the package with respect to the detector in a substantially straight line, in alignment with the detectable indicia substantially straight line.

The different parts may be maintained in normal sheet configuration as "inserts", or may be folded about fold lines to provide a multi-ply folded form, the plies of which may be adhesively connected, or merely unconnected "inserts". Step (b) may be practiced by inserting the multi-ply folded form into a mailing envelope, or by folding the parts about fold lines to provide a self-contained package in the form of a mailer. Step (a) may be practiced by imaging the magnetic toner detectable indicia on non-consecutive portions of the business form parts.

According to another aspect of the present invention, a multi-part business form is provided. The business form comprises: At least first and second business form parts, positioned in aligned relationship to provide a mailable element. Dense patterns of magnetic toner imaged on the parts, the pattern on the first part being at a different position than the pattern on the second part. And alphanumeric indicia of magnetic toner imaged on the parts in a less dense form than the dense patterns.

The dense patterns are preferably imaged on parts at positions such that when the form parts are aligned, the patterns are in a straight line configuration, with the dense patterns (e.g., solid toner rectangles) immediately adjacent one another. The parts may be folded about fold lines, and the folded parts may be disposed in a mailing envelope or may comprise a self-contained mailer. Typically, at least first, second and third parts are provided with the dense patterns in a straight line configuration. The dense magnetic toner patterns on the first, second, and third parts may be disposed so that they are not in linear sequence from one part to the next, although in a linear configuration in the multi-ply form.

It is a primary object of the present invention to provide an advantageous method of determining whether the correct business form parts have been provided in an outgoing package containing a plurality of parts, and a business form for use in the method. This and other objects of the invention will become clear from an inspection of the detailed description of the invention, and from the appended claims.

BRIEF DESCRIPTION OF THE DRAWINGS

FIG. 2 is a view like that of FIG. 1 for a modified form of the invention;

FIG. 3 is a schematic side view, with the parts shown with greatly exaggerated spacing for clarity of illustration, showing the mailer from FIG. 2;

FIG. 4 is a schematic view illustrating an apparatus that can be used in the practice of the method of the present invention.

DETAILED DESCRIPTION OF THE DRAWINGS

Figure 1:
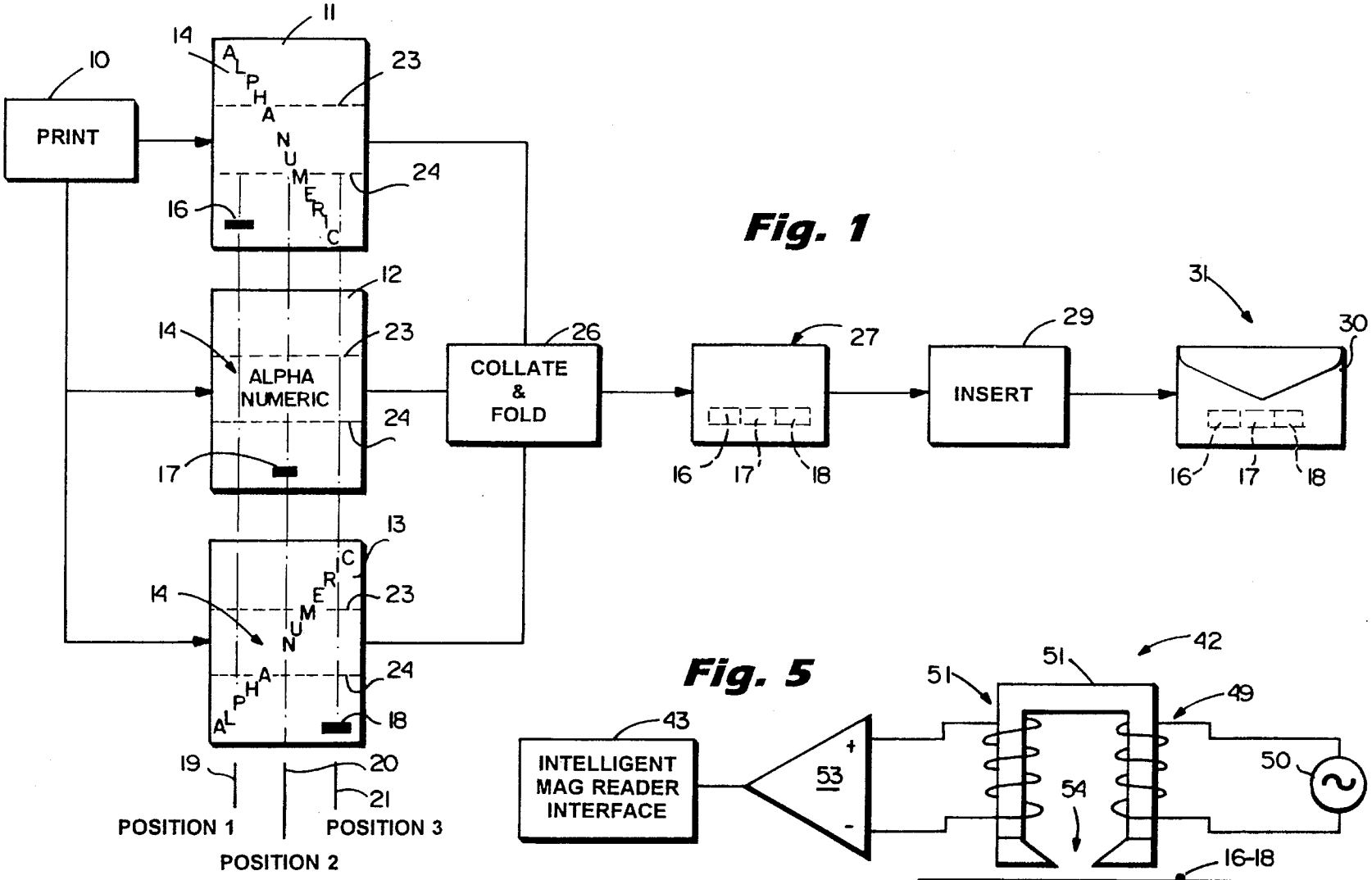
FIG. 1 is a schematic view illustrating method steps in the construction of a business form, and practicing the method, according to the invention, as well as schematically illustrating the business form components during various different steps during the construction thereof.

FIG. 1 schematically illustrates a print engine 10, such as a MIDAX printer, which is capable of imaging indicia with magnetic toner. One or more print engines 10 can be provided for printing on a plurality of parts of a business form, such as the first, second, and third parts 11, 12, and 13 seen schematically in FIG. 1. The print engine(s) 10 prints the alphanumeric indicia 14 on the parts 11 through 13, which is human readable indicia that will ultimately be reviewed by the recipient of the final mailing element produced according to the invention.

Preferably at the same time that the alphanumeric indicia 14 is being printed on the parts 11 through 13 with magnetic toner by the print engine(s) 10, dense patterns of magnetic toner are also being imaged on each of the parts 11 through 13. These dense patterns are shown in FIG. 1 in the form of substantially solid magnetic toner rectangles 16–18, although they could take other forms. The rectangles 16 through 18 are imaged on the forms 11 through 13, respectively, each of the rectangles 16 through 18 being on a different portion of the part 11 through 13 with which it is associated than the other rectangles 16 through 18. That is, the rectangle 16 is imaged at a first predetermined position 19, the rectangle 17 at a second predetermined position 20, and the rectangle 18 at a third predetermined position 21, the rectangles 16 through 18 preferably being disposed in a straight line configuration (with one rectangle immediately adjacent the other) in the final package formed.

After appropriate imaging of the indicia 14 and 16 through 18 on the parts 11 through 13, they are collated (assembled and aligned), and then preferably folded about fold lines 23, 24, as indicated by box 26 in FIG. 1. The collating and folding equipment used is standard. After collating and folding the folded multi-part form 27 is produced, and as can be seen by the dotted line, rectangles 16 through 18 in FIG. 1 for the multi-part form 27, the dense indicia patterns 16 through 18 are in a straight line. As indicated schematically at 29 in FIG. 1, the multi-part business form 27 may be inserted into another component to form a mailable package; e.g., it may be inserted into the mailing envelope 30 to form the final package 31. The final package 31 has at least one sheet of material (e.g., one of the parts 11 through 13 itself, or for the exact form illustrated in FIG. 1, at least one ply of the mailing envelope 30) which covers the indicia 16 through 18. However, because of the dense nature of the indicia 16 through 18 compared to the much less dense conventional alphanumeric indicia 14, indicia 16 through 18 can be sensed (detected) by a conventional magnetic detector.

FIGS. 2 and 3 illustrate a minor modification of the system configuration and the form of FIG. 1. In FIGS. 2 and 3 components comparable to those in FIG. 1 are shown by the same reference numeral only preceded by a "1".

The parts 111, 112, 113 illustrated in FIG. 2 are illustrated as parts that are designed to be formed into a self-contained mailer, typically having side edge perforation lines 34, 35, and end perforation line 36, and adhesive (not shown) within the marginal areas adjacent at least some parts of the perforation lines 34 through 36 to allow formation of the parts 111–113 into a self-contained mailer, as is conventional. In this case, the patterns of dense magnetic toner 116–118 are imaged in non-consecutive positions 119–121 from the first part 111 through the third part 113. This provides for even better integrity for package verification than for the embodiment of FIG. 1.

After imaging of the indicia 114, 116–118, at station 38 the parts 111, 112, 113 are not only collated and folded about the fold lines, but also the margins thereof are acted upon to activate the adhesive and thereby the parts 111–113 into a self-contained mailer 40. The mailer 40 is shown both in FIGS. 2 and 3, in FIG. 3 being shown very schematically with the component parts and spacing thereof greatly exaggerated in size for clarity of illustration. Note again that the patterns 116–118 are in a straight line, although not in the same sequence as illustrated in FIG. 1.

FIG. 4 illustrates an exemplary system for practicing the method according to the present invention in which the package 27, 40 from the FIG. 1 or the FIGS. 2 and 3 embodiment is moved relative to a conventional magnetic detector 42. Preferably, the detector 42 remains basically stationary, while the package 27, 40 moves in the direction 43. The direction 43 will depend upon the particular configuration of the detectable indicia 116–118, 16–18, in the package 31, Where the detectable magnetic toner elements 16–18, 116–118 are in a straight line configuration as illustrated in FIGS. 1 and 2, the direction of movement 43 of the package 31, 40 will also be linear, with the detector 41 aligned with respect to the indicia 16–18, 116–118. This relative movement and alignment can be accomplished utilizing conventional conveyors.

The magnetic detector 42 is—as earlier indicated —preferably of conventional construction. For example, it can be a VIKRON model 800-602, 800-604, or 800-620, available from Vikron, Inc. of Saint Croix Falls, Wis. The magnetic detector 42 is connected up to a conventional intelligent magnetic reader interface which in turn is connected to a conventional interface to a data system 45. The data system 45 includes a microprocessor or like computer, which in turn can be used to control a solenoid 46, which in turn may be control a mechanical element 47 for selectively deflecting/removing the package 31, 40 from its normal path should the detector 42 sense that not all of the detectable indicia 16–18, 116–118 are located within the package 31, 40 (or perhaps they are improperly positioned therewithin). The details of the deflector 47 are not important for the practice of the invention, and any conventional mechanical component for this purpose may be provided.

Figure 5:
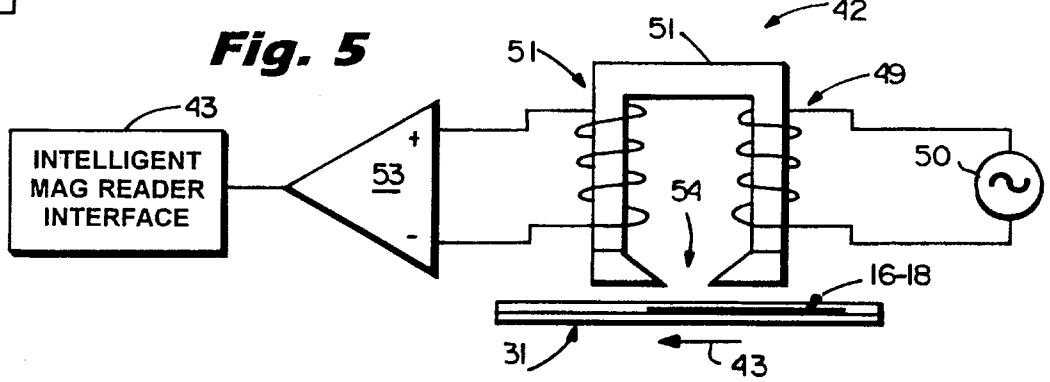
FIG. 5 is a logic view of a magnetic scanner that can be utilized as part-of the apparatus of FIG. 4 for detecting magnetic toner on business form parts.

FIG. 5 is a logic view of a particular magnetic detector 42 that may be utilized in the practice of the method of the invention. The detector 42 is known per se, and includes a primary winding 49 excited by an A.C. source 50, and. a secondary winding 51 used as a sense winding, the windings 49, 50 associated with a core 52. The winding 51 is connected up to an amplifier 53, which in turn is connected to the intelligent reader interface 43. The scanner 42 illustrated in FIG. 5 detects toner 16–18 (illustrated but very schematically in FIG. 5 in association with the package 31) as a result of the efficiency of the coupling increasing between the windings 49, 51 when the magnetic toner 16–18 passes under the gap 54 of the core 52. The sensor 42 thus has the ability of sensing not just the beginning and ending edges of the toner pattern 16–18 when passing by, but senses the presence of the toner patterns 16–18 at all times that they are passing under the gap 54. Note that the conventional alphanumeric indicia (e.g., 14, 114) imaged on the parts of the package are too disperse to significantly increase the magnetic coupling between the windings 49, 51.

While exemplary embodiments of the invention have been described above, it is to be understood that many modifications may be made. For example, the number of parts/inserts, the configuration of the ultimate package (e.g., self-mailer, envelope, parcel, etc.), the relative positions of the dense toner patterns, etc., may be varied widely within the scope of the invention. The invention is to be interpreted so as to encompass all equivalent structures and procedures.

What is claimed is:

1. A method of determining whether the correct business form parts have been provided in an outgoing package containing a plurality of parts, utilizing a magnetic detector capable of detecting magnetic toner within the package, comprising the steps of:

(a) imaging predetermined detectable indicia with magnetic toner on predetermined portions of each of the business form parts, the indicia located at a different position on different parts; then (b) forming the business form parts into a package so that the detectable magnetic toner indicia is covered by at least one sheet of material; then (c) providing the magnetic detector substantially stationary, and moving the package with respect to the detector so that the magnetic detector is positioned to sense the detectable magnetic toner indicia within the package; and then (d) sensing the detectable magnetic toner indicia within the package to determine whether all the correct parts are properly in the package by determining whether all business form parts within the package have the predetermined magnetic toner indicia the predetermined portions thereof;

(e) in response to step (d), rejecting a package if it is determined that the package does not have the predetermined detectable magnetic toner indicia on the predetermined portions thereof; and wherein step (a) is practiced to image the detectable magnetic toner indicia so that when formed into the package the indicia on the various parts is disposed in a substantially straight line; and wherein step (c) is practiced by moving the package with respect to the detector in a substantially straight line, in alignment with the detectable indicia substantially straight line.

2. A method as recited in claim 1 comprising the further step (f), between steps (a) and (b), of folding the business form parts about fold lines to provide a multi-ply folded form.

3. A method as recited in claim 2 wherein step (b) is practiced by inserting the multi-ply folded form into a mailing envelope.

4. A method as recited in claim 1 wherein step (a) is practiced by imaging rectangles of dense magnetic toner on the business form parts at the same time that alphanumeric indicia is being imaged on other portions of the business form parts with magnetic toner in less dense form.

5. A method as recited in claim 4 wherein step (a) is further practiced by imaging the detectable magnetic toner indicia on non-consecutive portions of the business form parts, when aligned to form a multi-ply form and formed into the package.

6. A method as recited in claim 1 comprising the further step (f), between steps (a) and (b), of folding the business form parts about fold lines to provide a multi-ply folded form.

7. A method as recited in claim 6 wherein step (b) is practiced by inserting the multi-ply folded form into a mailing envelope.

8. A method as recited in claim 6 wherein step (a) is further practiced by imaging the detectable magnetic toner indicia on nonconsecutive portions of the business form parts, when aligned to form a multi-ply form and formed into the package.

9. A method as recited in claim 1 wherein step (a) is practiced by imaging rectangles of dense, substantially solid, magnetic toner on the business form parts at the same time that alphanumeric indicia is being imaged on other portions of the business form parts by magnetic toner in less dense form.

10. A method as recited in claim 1 wherein step (b) is practiced by folding the business form parts about fold lines to provide a self-contained package in the form of a mailer.

11. A method of determining whether the correct business form parts have been provided in an outgoing package containing a plurality of parts, utilizing a magnetic detector capable of detecting magnetic toner within the package, comprising the steps of:

(a) imaging predetermined detectable indicia with magnetic toner on predetermined portions of each of the business form parts, the indicia located at a different position on different parts; then (b) forming the business form parts into a package so that the detectable magnetic toner indicia is covered by at least one sheet of material; then (c) moving the magnetic detector and package with respect to each other so that the magnetic detector is positioned to sense the detectable magnetic toner indicia within the package; and then (d) sensing the detectable magnetic toner indicia within the package to determine whether all the correct parts are properly in the package by determining whether all business form parts within the package have the predetermined magnetic toner indicia the predetermined portions thereof;

(e) in response to step (d), rejecting a package if it is determined that the package does not have the predetermined detectable magnetic toner indicia on the predetermined portions thereof; and wherein step (a) is practiced to image the detectable magnetic toner indicia so that when formed into the package the indicia on the various parts is disposed in a substantially straight line, and wherein step (c) is practiced by moving the package with respect to the detector in a substantially straight line, in alignment with the detectable indicia substantially straight line.

12. A method as recited in claim 11 comprising the further step (f), between steps (a) and (b), of folding the business form parts about fold lines to provide a multi-ply folded form.

13. A method as recited in claim 12 wherein step (b) is practiced by inserting the multi-ply folded form into a mailing envelope.

14. A method as recited in clam 11 wherein step (a) is practiced by imaging rectangles of dense magnetic toner on the business form parts at the same time that alphanumeric indicia is being imaged on other portions of the business form parts with magnetic toner in less dense form.

15. A method as recited in claim 14 wherein step (a) is further practiced by imaging the detectable magnetic toner indicia on non-consecutive portions of the business form parts, when aligned to form a multi-ply form and formed into the package.

16. A method as recited in claim 11 comprising the further step (f), between steps (a) and (b), of folding the business form parts about fold lines to provide a multi-ply folded form.

17. A method as recited in claim 11 wherein step (b) is practiced by folding the business form parts about fold lines to provide a self-contained package in the form of a mailer.

18. A method of determining whether the correct business form parts have been provided in an outgoing package containing a plurality of parts, utilizing a magnetic detector capable of detecting magnetic toner within the package, comprising the steps of:

(a) imaging predetermined detectable indicia with magnetic toner on predetermined portions of each of the business form parts, the indicia located at a different position on different parts; then (b) forming the business form parts into a package so that the detectable magnetic toner indicia is covered by at least one sheet of material; then (c) moving the magnetic detector and package with respect to each other so that the magnetic detector is positioned to sense the detectable magnetic toner indicia within the package; and then (d) sensing the detectable magnetic toner indicia within the package to determine whether all the correct parts are properly in the package by determining whether all business form parts within the package have the predetermined magnetic toner indicia the predetermined portions thereof;

(e) in response to step (d), rejecting a package if it is determined that the package does not have the predetermined detectable magnetic toner indicia on the predetermined portions thereof; and wherein step (a) is practiced by imaging rectangles of dense, substantially solid, magnetic toner on the business form parts at the same time that alpha numeric indica is being imaged on other portions of the business form parts by magnetic toner in less dense form.

19. A method as recited in claim 18 wherein step (b) is practiced by folding the business form parts about fold lines to provide a self-contained package in the form of a mailer.

20. A method as recited in claim 18 comprising the further step (f), between steps (a) and (b) of folding the business form parts about fold lines to provide a multi-ply folded form.

* * * * *